US006644447B2

(12) United States Patent
Pohl

(10) Patent No.: US 6,644,447 B2
(45) Date of Patent: Nov. 11, 2003

(54) WHEELED SUITCASE

(76) Inventor: Jürgen Pohl, Mühlenteichstrasse 75, D-33106 Paderborn (DE)

( * ) Notice: Subject to any disclaimer, the term of this patent is extended or adjusted under 35 U.S.C. 154(b) by 0 days.

(21) Appl. No.: 09/978,080

(22) Filed: Oct. 17, 2001

(65) Prior Publication Data

US 2002/0195303 A1 Dec. 26, 2002

(30) Foreign Application Priority Data

May 31, 2001 (DE) ..... 101 26 744

(51) Int. Cl.[7] ..... A45C 9/00; A45C 5/14; A45C 13/26; A45C 13/36

(52) U.S. Cl. ..... 190/8; 190/1; 190/18 R; 190/18 A; 190/115

(58) Field of Search ..... 190/1, 2, 8, 11, 190/18 R, 18 A, 108, 115; 297/129

(56) References Cited

U.S. PATENT DOCUMENTS

| | | | | | |
|---|---|---|---|---|---|
| 446,690 | A | * | 2/1891 | Nelson | 190/2 |
| 494,590 | A | * | 4/1893 | Newell | 190/2 |
| 588,721 | A | * | 8/1897 | Thomas | 190/18 A |
| 1,005,709 | A | * | 10/1911 | Jackson | 190/2 |
| 1,092,506 | A | * | 4/1914 | Oldroyd | 190/18 A |
| 2,510,754 | A | * | 6/1950 | Norlin | 190/18 A |
| 3,516,523 | A | * | 6/1970 | Pemberton, Jr. | 190/11 |
| 3,532,378 | A | * | 10/1970 | Dalia | 190/8 X |
| 3,557,916 | A | * | 1/1971 | Stowell | 190/18 R |
| 4,742,900 | A | * | 5/1988 | Boxhammer | 190/8 X |
| 5,374,073 | A | * | 12/1994 | Hung-Hsin | 190/18 A |
| 5,507,508 | A | | 4/1996 | Liang | |
| 5,899,467 | A | * | 5/1999 | Henkel | 190/1 X |
| 5,901,822 | A | | 5/1999 | Tu | |
| 5,941,352 | A | * | 8/1999 | Lee | 190/11 |
| 5,957,349 | A | * | 9/1999 | Krulik | 190/8 X |
| 6,016,893 | A | * | 1/2000 | Chen et al. | 190/18 A |
| 6,213,265 | B1 | * | 4/2001 | Wang | 190/18 A |
| 6,237,734 | B1 | * | 5/2001 | Chen | 190/18 A |

FOREIGN PATENT DOCUMENTS

| | | |
|---|---|---|
| DE | 297 07 355 U 1 | 8/1997 |
| DE | 299 22 842 U 1 | 3/2000 |
| WO | WO 98/03096 | 1/1998 |

* cited by examiner

*Primary Examiner*—Sue A. Weaver
(74) *Attorney, Agent, or Firm*—Browdy and Neimark, P.L.L.C.

(57) ABSTRACT

A suitcase (1) having an approximately cubic shape and two wheels (2) that are disposed near opposed bottom corners of the suitcase, also a handle (3) that is upwardly extendable and retractable from the suitcase (1) above the wheels (2) when the suitcase (1) is standing, furthermore a carrying handle affixed on an upper side of the suitcase and, optionally, an extendable floor support (20) located opposite the wheels on the floor side, with a seat surface disposed on the suitcase (1), which, when pulled, swiveled, swung or folded out when the suitcase is standing, completes the suitcase top (10).

14 Claims, 3 Drawing Sheets

WHEELED SUITCASE

BACKGROUND OF THE INVENTION

1. Technical Field of the Invention

The present invention is concerned with a suitcase having an approximately cubic shape and two wheels that are disposed near opposed bottom corners of the suitcase, also a handle that is upwardly extendable and retractable from the suitcase above the wheels when the suitcase is standing. Furthermore a carrying handle is affixed on an upper side of the suitcase and, optionally, an extendable floor support located opposite the wheels on the floor side.

2. Prior Art

Suitcases of the above type are generally known for traveling purposes. They permit luggage to be transported independently over long distances on train platforms and in airport terminals and also when waiting in line at counters or the like.

During long waits it is a shortcoming, however, that the known suitcases, since they are oriented with their smallest cube surface facing upward when they are standing, are not suitable for use as a seat, particularly also because of the carrying handle being located on top.

OBJECT AND SUMMARY OF THE INVENTION

It is the object of the invention to improve the above described suitcase in such a way that it is suitable as a seat.

This object is met in such a way that a seat surface is disposed on the suitcase, which, when swiveled, swung or folded out when the suitcase is standing, completes the top of the suitcase.

A suitcase that is equipped with this openable seat will advantageously have at least one sturdy frame or at least one sturdy upright shell that can absorb a significant portion of the seat load. The seat extends laterally from the support structure, and optionally over the same if the upper side of the suitcase is also wholly or partly used as a seat.

The opened seat area in each case is supported on the upper end of the support structure and furthermore hinged with a telescopic or folding support near a floor support.

In a preferred embodiment, the suitcase is divided into an undersuitcase and a hand suitcase that is fastened on top of the former and can be removed from the top and hooked-in on the side or swiveled off to the side in a hinged connection so that its top is flush with the undersuitcase, so that the two suitcases form a continuous seat surface towards the top. Both suitcases have a sturdy frame and/or shell structure that deflects the load to the floor support and wheels. The latter design involves the least additional time and expense.

The suitcase can be moved when the seat is open without having to adjust the telescopic extension of the handle, which is advantageous when waiting in long lines. When the seat is in use, the handle and telescopic extension assembly serve as a back or arm rest.

Advantageous embodiments are presented in the following FIGS. 1–7:

DETAILED DESCRIPTION OF THE PREFERRED EMBODIMENT(S) OF THE INVENTION

Figure 1:
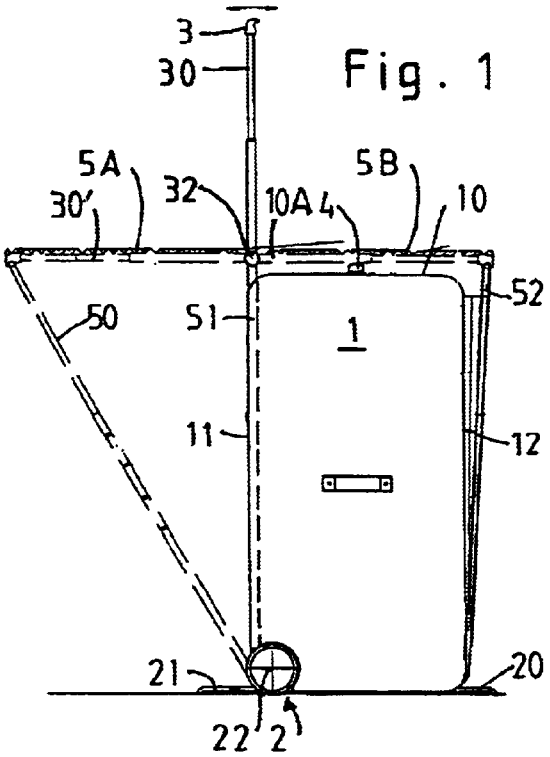
Figure 2:
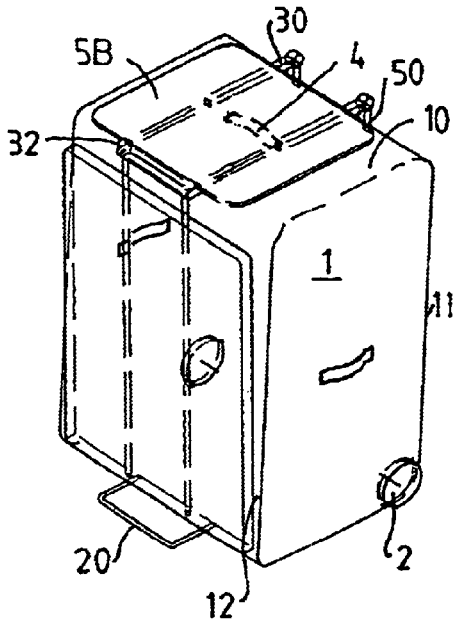
Figure 3:
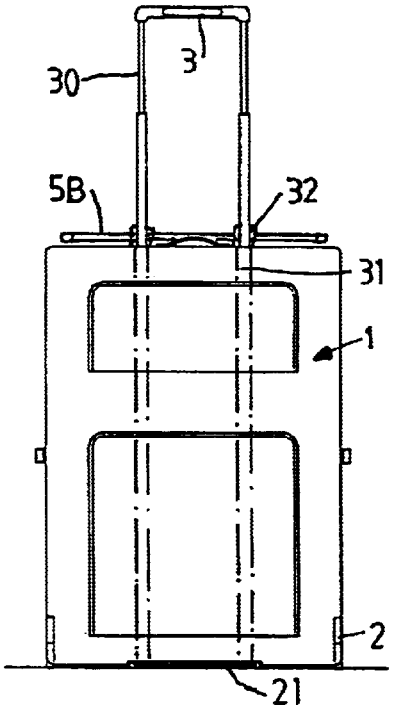
Figure 4:
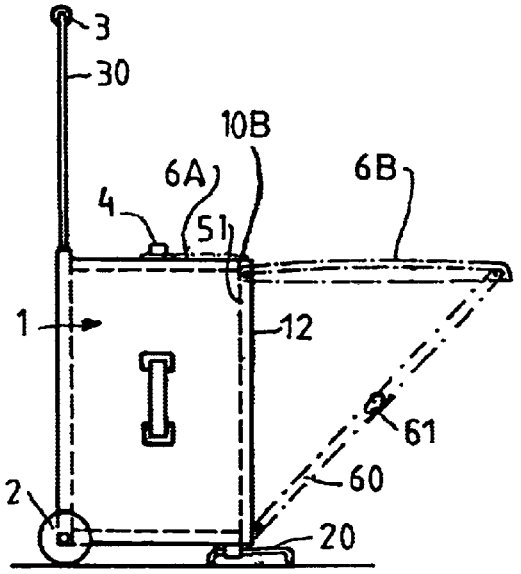
Figure 5:
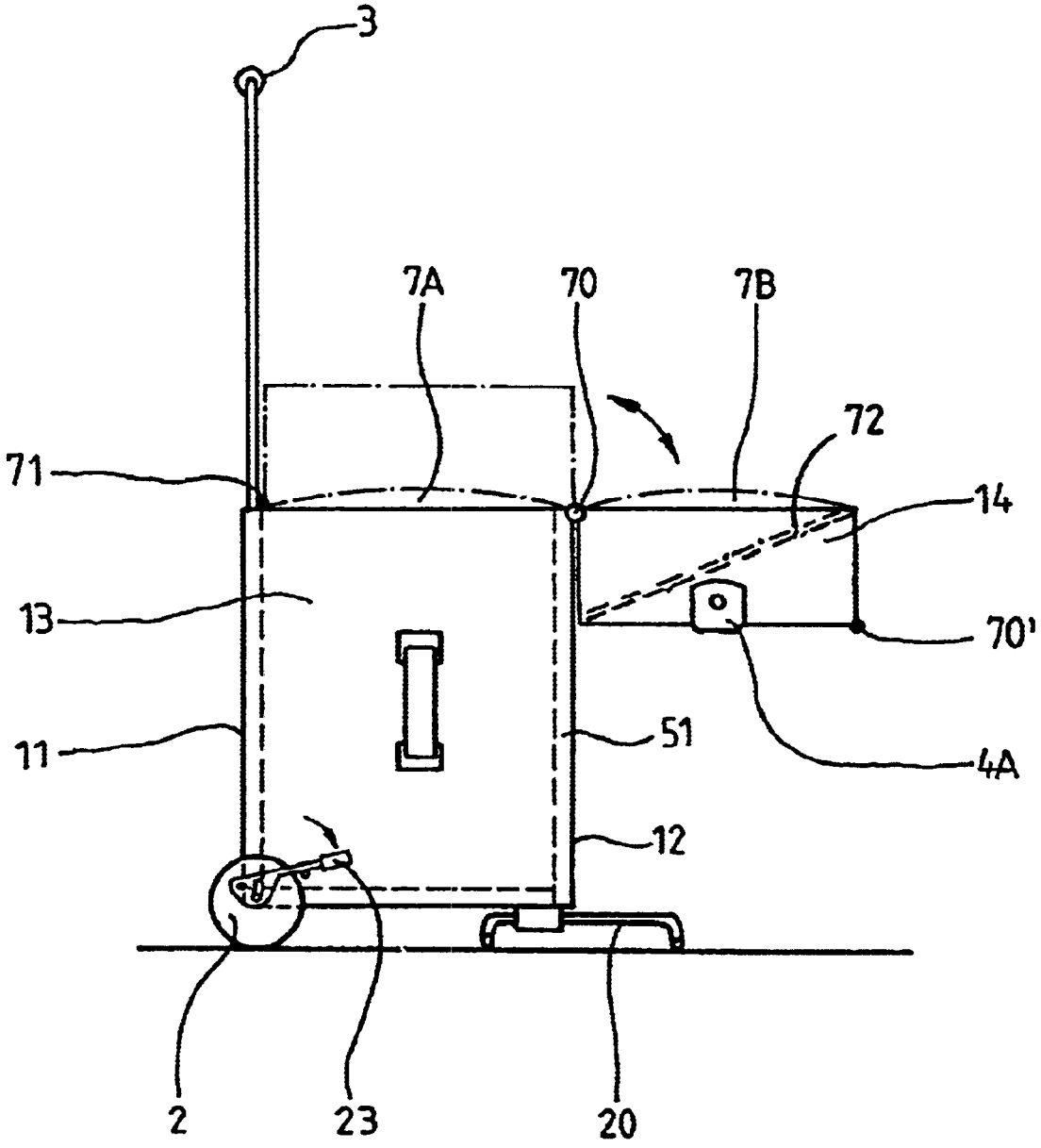
Figure 6:
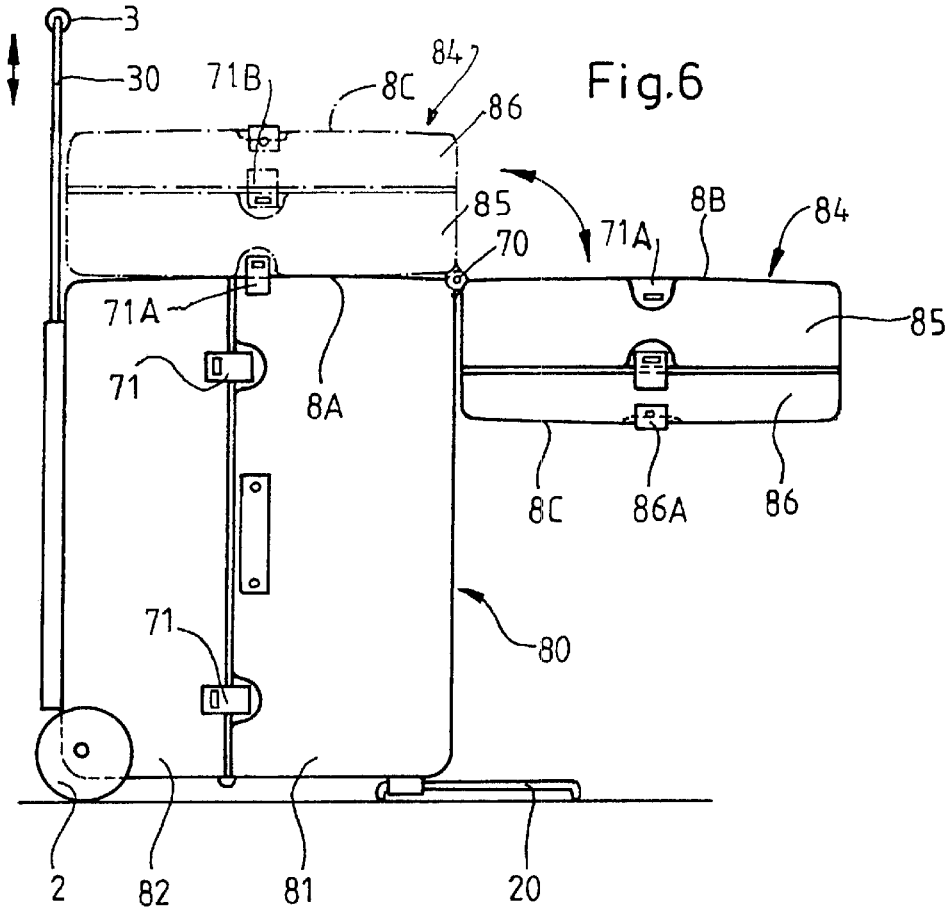
Figure 7:
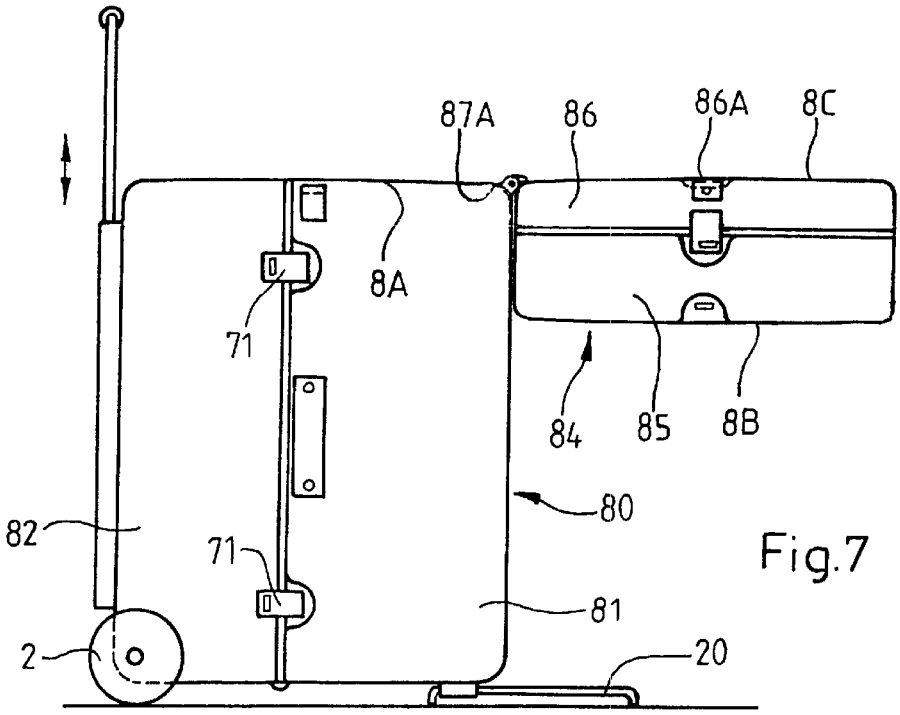

FIG. 1 shows the side view of a first suitcase embodiment with two swivel seats, FIG. 2 shows a perspective view for FIG. 1, FIG. 3 shows a front view for FIG. 1, FIG. 4 shows a second suitcase embodiment with fold-out seat, FIG. 5 shows a third suitcase embodiment with divided suitcase, FIG. 6 shows a shell-type suitcase variant of FIG. 5 with the upper part swiveled overend, FIG. 7 shows a shell-type suitcase variant with hooked-on upper part.

FIG. 1 shows a suitcase 1 with wheels 2 and retractable floor supports 20, 21 extended on both sides. On the front 11, where the axle 22 of the wheels 2 is located, a handle 3 is extendably fixed on telescopic tubes 30 in a known manner. A carrying handle 4 is fixed on the upper side 10 of the suitcase. A first swivel seat 5A, the seat surface of which transitions flush into a second swivel seat 5B, extends over said carrying handle 4.

Both seats 5A, 5B are supported on the upright tubes 31 of the telescopic tubes 30 or in a central frame 51, on a pivot hinge 32, around the axis of which the extension tube assembly 30 can be swiveled as well.

When the suitcase is moved, the extension tube assembly 30 is swiveled upward and locked in the pivot hinge 32, and when the seat 5A is opened, the extension tube assembly 30' is swiveled out to the side and supported at its free end with a telescopic support 50 that is swiveled out diagonally and hinged near the axle 22. The opened seat 5A rests on the extension tube assembly 30'. A floor support 21, which in its extended position protrudes beyond the rollers 2, prevents the seat 5A from tipping over the rollers 2.

The second seat 5B is supported on a solid or swivelable support 52 on the back, the lower end of which extends to a point near the floor support 20, which can be extended there.

When the suitcase 1 is moved, the seats 5A, 5B and the supports 50, 52 are swiveled close to the front 11 and back 12 and held there in locked positions. The carrying handle 4 is then freely accessible, as shown in FIG. 2.

FIG. 3 shows an in-between stage, in which only the seat 5B has been brought into the supported position on the upper side 10 of the suitcase. In a simple embodiment, only this seat 5B is provided, which bridges the carrying handle 4 that would otherwise interfere with sitting.

FIG. 4 shows a further variant of the suitcase in which a seat 6B is hinged on the top of the back 12 of the suitcase in a manner so that it can be folded down from the top. The seat surface of this folding seat 6B transitions seamlessly into the upper side 10 of the suitcase, which functions partly as a seat 6A and is fully usable as a seat up to the carrying handle 4.

The back 12 of the suitcase is stabilized by a frame 51 or shell that serves as a central support. At a distance from the back 12, the folding seat 6B is supported with a folding support 60 toward the floor support 20. The folding support 60 has a folding joint 61, which, in a slightly over-extended position, has a limit stop to prevent it from buckling. In the folded-down position of the seat 6B the folding tube assembly 60 is collapsed behind the seat, folded inward.

The folding tube assembly 60 is preferably hinged at its lower end to the outer area of the extendable floor support 20, so that the floor support 20 is pulled out without problem when the folding seat 6B is swiveled up, and retracted when the seat is swiveled down, which results in an extremely simplified handling and always ensures a secure stand.

The extendable floor support 20 is preferably bent at a right angle not only at its outer end toward the floor, but also at its inner end. This results in an increased steadiness and support for the back 12 of the suitcase, which is particularly stressed when the seat is in use.

A further, very practical variant of the suitcase with seat is shown in FIG. 5. The suitcase comprises a larger undersuitcase 13 and a smaller hand suitcase 14 having approximately the same cross section. For moving purposes the hand suitcase 14 can be fixed on the undersuitcase 13 in such a way that the carrying handle 4A of the hand suitcase 14 serves for both of them together. The sitting position is attained in such a way that the hand suitcase 14 is positioned, preferably with its side opposite the handle facing upward, flush against the upper side of the undersuitcase so that the two sides that are facing upward form the partial seats 7A, 7B.

The hand suitcase 14 incorporates a diagonal stiffener (72) extending from its upper face end to an opposite lower end when the suitcase 14 is in the sitting position against the frame 51. This permits absorption of the moments of a user through frame 51 down through floor support 20.

The connection 70 of the two suitcases 13, 14 in the sitting position is releasable, e.g., designed with hooks and eyes or a zip fastener, and the connection 71 on the front in the moving position is releasable as well, e.g., designed with clamping and snap-in connectors as they are commonly used for suitcases.

The hand suitcase 14 has a respective stiffener 72 at least on the side of the seat and in the side that is supported against the undersuitcase 13 in the sitting position, to absorb the support moments. The undersuitcase 13 is similarly stiffened on its back 12 with a central frame 51, which is supported at its lower end on the extendable floor support 20.

In a modified form, the need to turn the hand suitcase 14 on its head can also be eliminated if it is hooked with a connection 70', e.g., with eyes, on its upper side to the connector 70, e.g., to hooks, on the undersuitcase 13. The handle 4A on the upper side is then located on the seat surface and is suitably designed so that it can be placed flat, e.g., it is designed to extend over the entire upper side of the hand suitcase 14 and fastened laterally.

The presented variants represent preferred embodiments, the elements of which, such as telescopic supports, swivel supports, folding supports and swivel seat, hand suitcase seat, folding seat, may also be combined in other ways and opened at the front or back.

The version with the hand suitcase that can be attached laterally and to the upper side permits a secure and comfortable transportation of the same when moved and its separate handling as carry-on luggage during air travel. The undersuitcase 13 has a comfortable seat height. The extension tube assembly of the handle may be used as a back rest for sitting.

The supports and hinges shown in the side views exist parallel at least twofold in the depth of the drawing and are connected to one another via the seat that is fastened to the same or via the suitcase.

The seat surfaces of the seats 5A, 5B; 6A, 6B; 7A, 7B; 8A, 8C are preferably provided with a thin padding.

To better secure the suitcase against unintentional rolling when there is momentarily no load on the floor support 21 while a person is sitting down or standing up, a foot operated eccentric brake 23 is affixed to each of the wheels 2.

FIG. 6 shows a shell-type suitcase variant 80 with the two shell parts 81, 82 circumferentially joined in the usual manner, which, in their closed condition—not shown—are connected with a hinge on one side and with locking latches 71 on the other side.

Furthermore, in the presented example, the upper part 84 of the suitcase, i.e., the hand suitcase, is assembled of sturdy plastic shells 85, 86 and also closed with a hinge and locking latch 71B in its closed condition. The base suitcase 80, as in the previous examples, is provided with rollers 2, a stand 20, a telescopic tube 30, with a handle 3.

In the moving position, the hand suitcase is the upper part 84—shown in a dot-and-dash line—and held with its bottom 8A on the base suitcase 80 by means of locking latches 71A. In the moving position, the bottom of the upper part 84 is turned upward and forms, together with the surface of the base suitcase 80, a continuous seat surface in such a way that both suitcase parts are connected in a releasable pivot joint 70 at the abutting edges. The carrying handle 86A on the upper shell 86 of the upper part 84 is facing downward in this position and thus does not interfere with the sitting.

FIG. 7 shows a similar shell-type suitcase combination as described above. However, in this case the upper part 84 is left in the same orientation in the presented sitting position as in the moving position, which is not shown, and fixed with a releasable connection 87A on an upper edge of the upper shell 86 of the upper part 84 to the adjoining edge on the upper side of the base suitcase shell 81. The upper side 8C of the upper shell 86 thus serves as a seat surface. The handle 86A is flat and/or recessed into the surface 8C so as not to interfere with the sitting. The releasable connection 87A is preferably composed of hooks and eyes with a small overhang so that they do not cause any noticeable interference when the upper part 84 is detached.

The shell design of the base suitcase 80 and upper part 84 imparts sufficient carrying stability to serve as a seat for one person. The placement of the connection 70, 87A between the suitcase parts in the stiff shell edges provides sufficient carrying capacity for sitting.

List of Reference Numerals

| | |
|---|---|
| 1 | Suitcase |
| 10 | Upper side of the suitcase |
| 10A | Upper side on the handle side |
| 10B | Upper side facing away |
| 11 | Suitcase handle side = front |
| 12 | Back of suitcase |
| 13 | Undersuitcase |
| 14 | Hand suitcase |
| 2 | Wheels |
| 20 | Floor support |
| 21 | Floor support |
| 22 | Axle |
| 23 | Foot brake |
| 3 | Handle |
| 30 | Extension tube assembly - vertical |
| 30' | Extension tube assembly - positioned horizontally |
| 31 | Upright tube for 30 |
| 32 | Pivot joint on 31 |
| 4 | Carrying handle on 10 |
| 4A | Carrying handle on 14 |
| 5A, 5B | Swivel seats |
| 6A | Seat area on the top cover side |
| 6B | Swivel seat |
| 7A | Top cover seat |
| 7B | Folding seat |
| 50 | Telescopic support |
| 51 | Central frame |
| 52 | Pivot support |
| 60 | Folding support |
| 61 | Folding joint |
| 70 | Releasable hinge connector - zip fastener |
| 70' | Releasable hinge connector on top of 14 |

-continued

| | |
|---|---|
| 71, 71A, 71B | Releasable connector - locking latch |
| 72 | Stiffeners for 14 |
| 80 | Shell-type suitcase |
| 81 | Undersuitcase shells |
| 82 | Undersuitcase shells |
| 84 | Hand suitcase composed of shells |
| 85 | Shells of the hand suitcase, upper shell |
| 86 | Shells of the hand suitcase, upper shell |
| 8A–8C | Surfaces |
| 87A | Releasable connection |
| 86 | Hand suitcase handle |

What is claimed is:

1. A suitcase (1; 13, 14) having a substantially cubic shape, the suitcase comprising:

two wheels (2) rotatably engaged on a bottom side of the suitcase;

a floor support extendable from the bottom side of the suitcase;

a handle engaged on a telescopic tube assembly which is upwardly extendable and retractable from the suitcase above the wheels when the suitcase is standing;

a displaceable part rotatably engaged on a top side of the suitcase which in a displaced position is coplanar with the top side of the suitcase;

a support extending downward from a free end of the displaceable part to a front side of the suitcase and bearing down through the floor support when the displaceable part is in the displaced position thereof;

wherein the displaceable part is a first partial seat and the top side of the suitcase is a second partial seat which together create a complete seat surface; and wherein the handle and the telescopic tube assembly are engaged on a wheel side of the suitcase.

2. The suitcase according to claim 1, wherein the support is hinged at a first end at the free end of the displaceable part and at a second end at the front side of the suitcase and has a folding joint between the first end and the second end.

3. The suitcase according to claim 2, wherein the second end is hinged on the front side of the suitcase above the floor support.

4. The suitcase according to claim 1, wherein the first partial seat is rotatable on a pivot joint on an upright frame on the front side of the suitcase.

5. The suitcase according to claim 4, wherein the first partial seat rotates down against the upright frame when the support is folded around the folding joint under the first partial seat and against the front side of the suitcase.

6.The suitcase according to claim 1, comprising a larger suitcase on which the telescope tube assembly is located and wherein the displaceable part is a smaller hand suitcase, a bottom side of the hand suitcase defining the first partial seat when in the displaced position thereof.

7. The suitcase according to claim 6, wherein the support is a diagonal stiffener incorporated in the hand suitcase from an upper free end thereof to an opposite lower end thereof.

8. The suitcase according to claim 6, wherein a carrying handle is affixed on a top side of the hand suitcase.

9. The suitcase according to claim 6, wherein the smaller hand suitcase is releasably engaged to the large suitcase on a pivot joint.

10. The suitcase according to claim 9, wherein the pivot joint is a zip fastener or hooks and eyes respectively engaged between the suitcase and the hand suitcase.

11. The suitcase according to claim 1, wherein the first and second partial seats have a padding or cover.

12. The suitcase according to claim 1, wherein a wheel lock is disposed on at least one of the two wheels.

13. The suitcase according to claim 12, wherein the wheel lock has a foot lever that acts on the wheel in a braking manner with an eccentric cam.

14. The suitcase according to claim 1, wherein a carrying handle is affixed on the top side of the suitcase.

* * * * *